US006650524B2

(12) United States Patent
Koyasu

(10) Patent No.: US 6,650,524 B2
(45) Date of Patent: Nov. 18, 2003

(54) POWER SUPPLY CIRCUIT WITH ADAPTIVE ERROR DETECTION AND AN ELECTRONIC CONTROL CIRCUIT INCLUDING THE SAME

(75) Inventor: Takahisa Koyasu, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/122,781

(22) Filed: Apr. 15, 2002

(65) Prior Publication Data

US 2002/0149350 A1 Oct. 17, 2002

(30) Foreign Application Priority Data

Apr. 16, 2001 (JP) ..... 2001-116778

(51) Int. Cl.[7] ..... H02H 5/04
(52) U.S. Cl. ..... 361/93.8; 361/18
(58) Field of Search ..... 361/18, 93.8, 93.9, 361/93.7, 93.1; 323/907, 277

(56) References Cited

U.S. PATENT DOCUMENTS 5,550,462 A * 8/1996 Nakajima ..... 323/277
5,859,757 A * 1/1999 Hanafusa et al. ..... 361/100

FOREIGN PATENT DOCUMENTS

| | | |
|---|---|---|
| JP | 9-191556 | 7/1997 |
| JP | 10-284952 | 10/1998 |
| JP | 11-24764 | 1/1999 |

* cited by examiner

*Primary Examiner*—Shawn Riley
(74) *Attorney, Agent, or Firm*—Harness, Dickey & Pierce, PLC

(57) ABSTRACT

A supply current is supplied to an error detection circuit for detecting an error condition of an IC of the power supply circuit such as an overheat detection circuit only when the detection current of the power transistor of the power supply circuit is higher than a reference. Moreover, a supply current to the constant current source is supplied only when the detection current of the power transistor is higher than the reference to suppress the power consumption. Thus, suppression of the power consumption in the battery backup operation for a RAM during ignition off condition is provided. The current detection of the power transistor of the power supply circuit is detected with a series resistor or a multi-collector transistor.

10 Claims, 4 Drawing Sheets

POWER SUPPLY CIRCUIT WITH ADAPTIVE ERROR DETECTION AND AN ELECTRONIC CONTROL CIRCUIT INCLUDING THE SAME

BACKGROUND OF THE INVENTION

1. Field of the Invention

This invention relates to a power supply circuit and an electronic control unit including the same.

2. Description of the Prior Art

Electronic control units (ECUs) for a motor vehicle may have a power supply circuit for supplying a backup power from a backup battery to the RAM therein to hold the data while the main power is OFF. In such an ECU, because the capacity of the backup battery is not so large, reduction in power consumption in the power supply circuit is required.

FIG. 4 is a schematic circuit diagram of a prior art power supply circuit 1 for generating and supplying a backup power from a backup battery (not shown) to the RAM (not shown) in the electronic control unit (not shown) to hold the data while the main power is OFF. This power supply circuit 1 has a series regulator structure. That is, the base of the output power transistor Q1 is controlled by an output of an operational amplifer 7 which represents the difference between a reference voltage Vr and the detection output voltage Vd which is derived by voltage-dividing the output voltage Vo of the output power transistor Q1 to make the output voltage constant. The power supply circuit 1 further includes an overheat detection circuit 8 for detecting overheat which may be caused by a relatively large magnitude of the output current of the power supply circuit 1. The overheat detection circuit 8 is supplied with a bias current from a constant current source 9. Here, the bias current is always supplied to the overheat detection circuit 8, so that the power consumption in the overheat detection circuit 8 and the accompanying circuits is negligible. Therefore, suppress in the power consumption in the power supply circuit for backup for the RAM is further required.

SUMMARY OF THE INVENTION

Another aim of the present invention provides a power supply circuit capable of suppression of current for error detection and a superior electronic control unit including the same.

In accordance with one aspect of the present invention, a magnitude of a current flowing through a power transistor in the power supply circuit is detected, and an error condition which may be caused by a relatively great magnitude of the current is detected by an error detection circuit, which is operated when the magnitude of the current is greater than a threshold value to suppress power consumption.

Another aspect of the present invention provides a power supply circuit capable of suppressing power consumption, wherein the transistor supplies a current to a load, a current detection circuit detects a magnitude of the current, an error detection circuit detects an error condition which may be caused by a relatively great magnitude of the current and outputs the detection result; and a control circuit operates the error detection circuit when the magnitude of the current is greater than a threshold value.

The control circuit may include a bias circuit for supplying a bias current to the error detection circuit to operate the error detection circuit when the magnitude of the current is greater than the threshold value.

The current detection circuit may include a resistor connected in series with the transistor and the load; and a transistor turning ON on the basis of a voltage drop between the resistor.

The error detection circuit may detect overheat in the power supply circuit as the error condition.

The control circuit may include a bias circuit for supplying a bias current to the error detection circuit to operate the error detection circuit when the magnitude of the current is greater than the threshold value.

The transistor may include a multi-collector structure including a first collector supplying the current and a second collector supplying a detection current corresponding to the current to detect the magnitude of the current, and wherein the current detection circuit includes the second collector.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Figure 3:
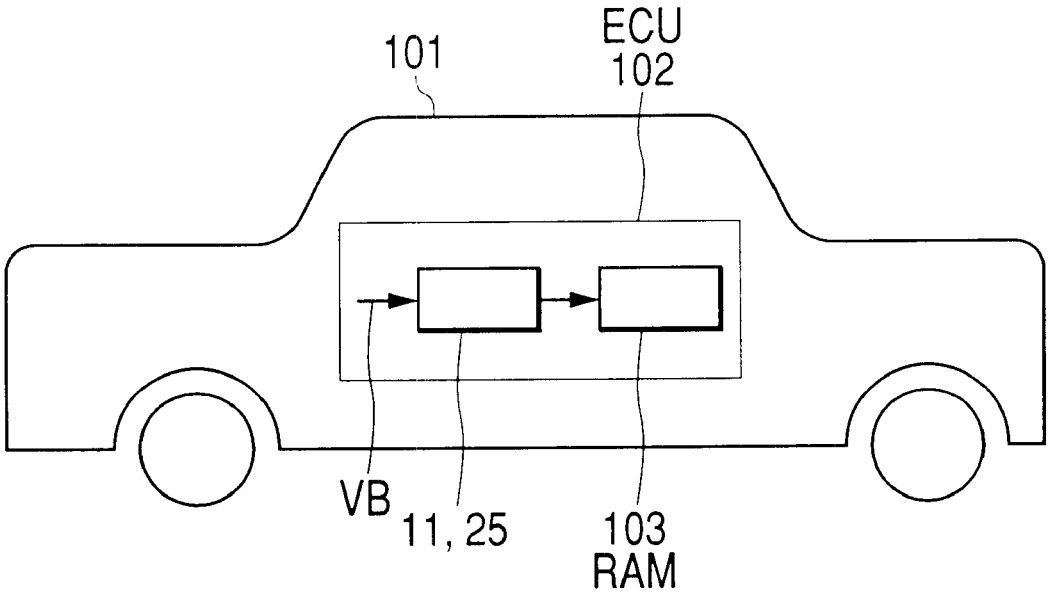
FIG. 3 is an illustration of a motor vehicle having an electronic control unit (ECU) including a RAM and a power supply circuit according to the invention.
Figure 4:
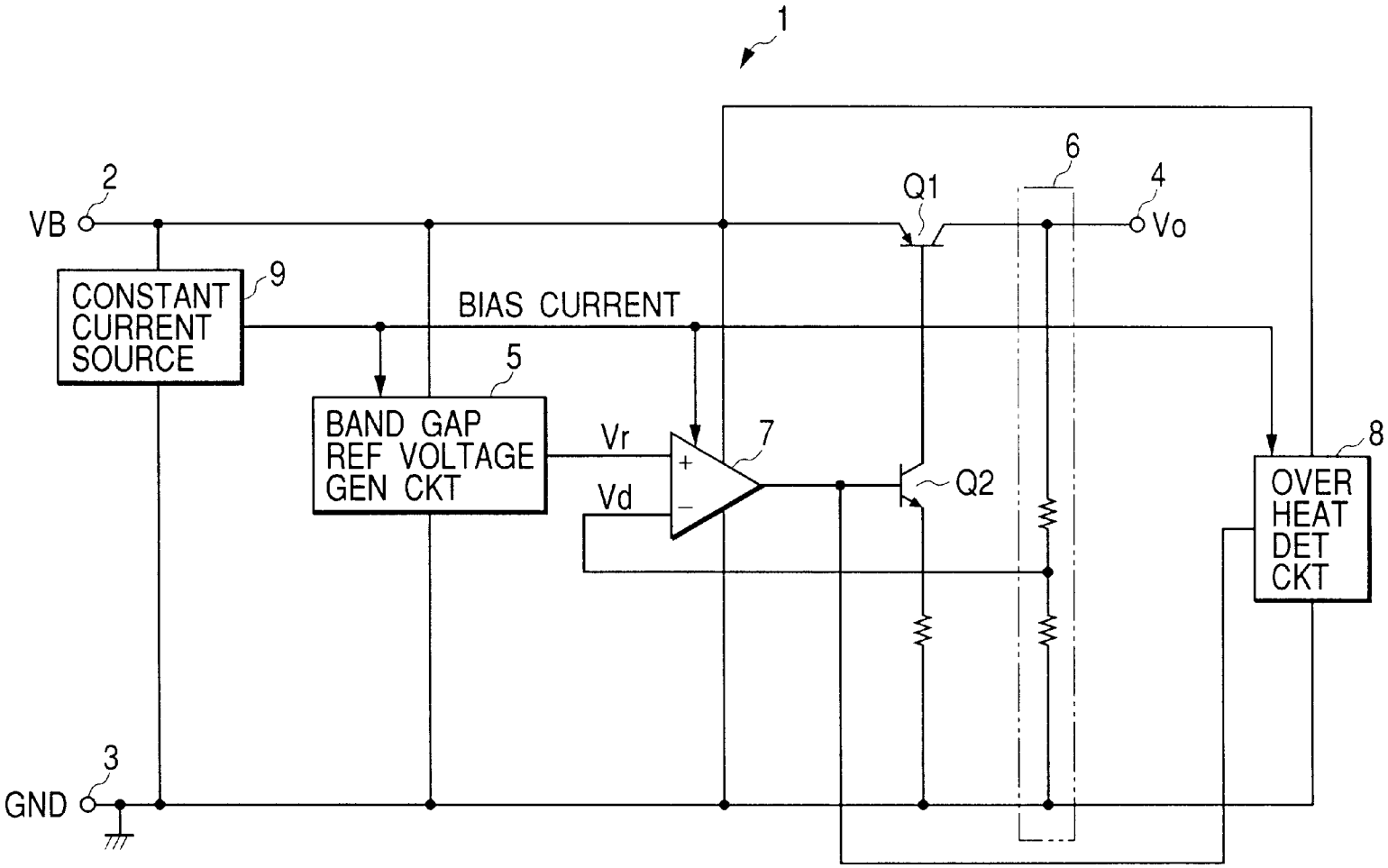
FIG. 4 PRIOR ART
FIG. 4 is a schematic circuit diagram of a prior art power supply circuit.

FIG. 3 is an illustration of a motor vehicle 101 having an electronic control unit (ECU) 102 including a RAM 103 and a power supply circuit 11 or 25. The ECU 102 is supplied with a main power while an ignition switch (not shown) is ON. The power supply circuit 11 or 25 supplies a backup power for the RAM 103. More specifically, in the ignition OFF condition, the power supply circuit 11 or 25 supplies the regulated backup power from a battery voltage VB from a backup battery (not shown) to hold the data in the RAM 103.

[First Embodiment]

Figure 1:
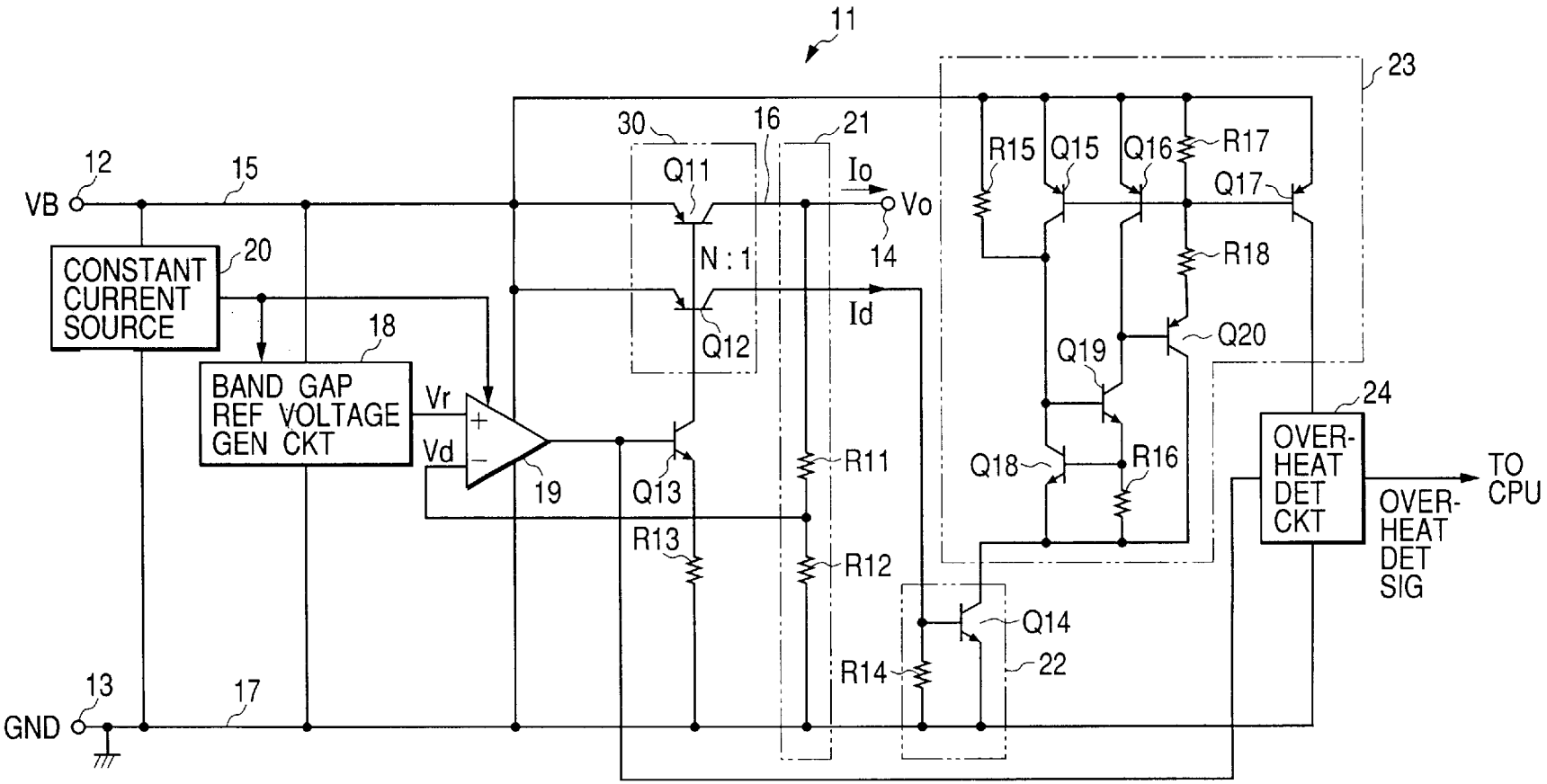
FIG. 1 is a schematic circuit diagram of a power supply circuit according to a first embodiment of the present invention.

FIG. 1 is a schematic circuit diagram of the power supply circuit 11 for generating and supplying a backup power from a battery voltage VB to the RAM 103 in the electronic control unit 102 for the motor vehicle 101. The ECU 102 executes at least one of various control operations such as engine control, ABS control, air back control, air conditioner control, body control, and power steering control while the ignition switch is ON. The ECU 102 is supplied with a main power from another main power supply circuit while the ignition switch is ON and is supplied with the backup power from the power supply circuit 11 substantially only when the ignition switch is OFF to hold the data in the RAM 103. Because the capacity of the backup battery is not so large, reduction in the power consumption in the power supply circuit 11 is required.

The power supply circuit 11 has a series regulator structure to supply the regulated supply voltage Vo and is formed in a monolithic IC. The power supply circuit 11 is continuously supplied with the battery voltage VB between an input terminal 12 and a GND terminal 13 thereof and continuously supplies the supply voltage Vo to the RAM 103 as a load between the output terminal 14 and the GND terminal 13 while the ignition switch is OFF.

In the power supply circuit 11, an input power line 15 is connected to the input terminal 12, an output power line 16 is connected to the output terminal 14, and a GND line 17 is connected to the GND terminal 13.

Between the input power line 15 and the output power line 16, a PNP transistor Q11 (output power transistor) is connected. More specifically, the emitter of the PNP transistor Q11 is connected to the input power line 15, and the collector of the PNP transistor Q11 is connected to the output power line 16. Moreover, the input power line 15 is also connected to an emitter of a PNP transistor Q12. In fact, a multi-collector transistor has a multi-collector structure 30 including the PNP power transistor Q11 and the PNP transistor Q12, wherein a ratio of areas of emitters of the PNP transistors Q11 and Q12 is N:1 (N>1). This structure provides a detection current Id of which magnitude is 1/N of the collector current (output current) Io of the PNP transistor Q1. The ratio of N:1 is determined to provide a sufficient magnitude of the detection current Id for controlling the bias controlling (mentioned later), but to suppress the power consumption caused by the detection current Id.

Between the input power line 15 and the GND line 17, a band gap reference voltage generation circuit 18 for generating a reference voltage Vr, an operational amplifier 19 for amplifying a difference voltage, a constant current source 20 for supplying a bias current to the band gap reference voltage generation circuit 18 and the operational amplifier 19 are provided. Moreover between the output power line 16 and the GND line 17, a voltage dividing circuit 21 including resistors R11 and R12 connected in series is provided. The voltage dividing circuit 21 divides the output voltage Vo to output the divided voltage as a detection voltage Vd. The reference voltage Vr is supplied to a non-inverting input of the operational amplifer 19 and the detection voltage Vd is supplied to the inverting input of the operational amplifier 19.

An NPN transistor Q13 drives the PNP transistors Q11 and Q12 on the basis of the output of the operational amplifier 19. That is, the collector of the NPN transistor Q13 is connected to the bases of the PNP transistors Q11 and Q12, and the emitter is connected to the GND line 17 through a resistor R13. The operational amplifier 19 includes, therein, a clamp circuit (not shown) for clamping the output voltage thereof. Thus, the maximum base currents of the PNP transistors Q11 and Q12 are determined on the basis of the clamp voltage of the clamp circuit of the operational amplifier 19 and the resistance of the resistor R13.

The collector of the transistor Q12 is connected to the ground line 17 through a resistor R14 and connected to a base of an NPN transistor Q14. The emitter of the NPN transistor Q14 is connected to the ground line 17. The resistor R14 and the NPN transistor Q14 form a bias control circuit 22 for controlling a constant current source 23.

The constant current source (bias circuit) 23 including transistors Q15 to Q20 and resistors R15 to R18 is connected between the input power line 15 and the collector of the NPN transistor Q14. That is, the bias control circuit 22 controls the operation of the constant current source 23.

The emitters of the PNP transistors Q15 to Q17 are connected to the input power line 15, and bases of these transistors are commonly connected to an end of a resistor R17. The opposite end of the resistor R17 is connected to the input power line 15. The end of the resistor R17 is connected to an end of a resistor R18 of which opposite end is connected to the emitter of the PNP transistor Q20. The collector of the PNP transistor Q20 is connected to the collector of the NPN transistor Q14. The collector of the transistor Q16 is connected to the base of the PNP transistor Q20 and to the collector of the NPN transistor Q19 of which emitter is connected to the base of the NPN transistor Q18 and to an end of the resistor R16. The opposite end of the resistor R16 is connected to the collector of the NPN transistor Q14.

The resistor R15 is connected between the emitter and the collector of the PNP transistor Q15 in parallel. The collector of the PNP transistor Q15 is connected to the base of the NPN transistor Q19 and to the collector of the NPN transistor Q18. The emitter of the NPN transistor Q18 is connected to the collector of the NPN transistor Q14.

Between the collector of the PNP transistor Q17 and the ground line 17, an overheat detection circuit 24 is connected. The overheat detection circuit 24 operates in response to the supply of a bias current from the constant current source 23, and detects an overheat condition of the IC of the power supply circuit 11 on the basis of a forward voltage drop of a diode (not shown) included in the overheat detection circuit 24. The overheat condition is mainly caused by the heat derived from the collector dissipation in the output power transistor Q11.

[Operation]

The band gap reference voltage generation circuit 18, the operational amplifier 19, and the constant current source 20 continuously operate because they are continuously supplied with the battery voltage VB while the ignition key is OFF. The operational amplifier 19 controls the base current of the PNP power transistor Q11 to equalize the detection voltage Vd to the reference voltage Vr through the transistor Q13. This controls the output voltage Vo at a constant voltage corresponding to the reference voltage Vr as long as the overheat protection operation by the overheat detection circuit 24 does not occur.

When the output current Io flows from the PNP power transistor Q11, a detection current Id of which magnitude is 1/N of the output current Io flows from the collector of the PNP transistor Q12 to the resistor R14 in the bias control circuit 22. This develops a voltage drop between the resistor R14. If it is assumed that the voltage difference between the base and emitter of the NPN transistor Q14 in the ON condition is VF and that the resistance of the resistor R14 is represented as "(R14)", the NPN transistor Q14 turns ON under the condition represented by the equation as follows:

$$Io \geqq VF \times N/(R14) \quad (1)$$

In other words, the resistance (R14) is determined together with the magnitude of the detection current Id such that the NPN transistor Q14 turns on when the output current Io exceeds the threshold current. When the NPN transistor Q14 turns on, the constant current source 23 supplies a supply current having a constant current magnitude. This makes a constant bias current flowing through the transistor Q17 into the overheat detection circuit 24. This starts the overheat detection operation. When the overheat detection circuit 24 detects an overheat condition of the IC, the overheat detection circuit 24 decreases the base voltage of the NPN transistor Q13 to turn OFF the PNP power transistor Q11 and supplies an overheat detection signal to a CPU (not shown) to execute an overheat protection operation, wherein this CPU is also battery-backed with other power source.

When the output current Io decreases under the threshold current (VF×N/(R14)), the collector dissipation of the PNP power transistor Q11 decreases. This eliminates the overheat condition. In this condition, the NPN transistor Q14 turns off, so that the current to the constant current source 23 is cut off, and thus, the PNP transistor Q17 turns off to cut off the bias current to the overheat detection circuit 24. This stops the operation of the overheat detection circuit 24.

According to this embodiment, the bias current to the overheat detection circuit 24 is not supplied by cutting off the current supplied to the constant current source 23 when the output current Io is low (in a normal condition). Thus, the power consumption of the IC is reduced by the power consumption in the constant current source 23 and the overheat detection circuit 24 from the power consumption in the case that the supply power would be constantly supplied to these circuits. On the other hand, if the output current Io increases, the constant current source 23 and the overheat detection circuit 24 are operated to protect the IC from the overheat condition.

Because the magnitude of the detection current Id is proportional to that of the output current Io, the lower the output current Io, the lower the detection current Id. Thus, the lower output current Io provides the lower power consumption in the current detection circuit. Moreover, the bias control circuit 22 has a simple structure because it includes only the NPN transistor Q14 and the resistor R14, and the NPN transistor Q14 does not supply its collector current as long as the output current Io is lower than the threshold current (VF×N/(R14)). These facts can suppress increase in power consumption due to addition of the bias control circuit 22.

In this embodiment, the output current Io of the power supply circuit 11 becomes zero during the ON condition of the ignition switch because the ECU 102 is supplied with the supply voltage from the main power supply circuit. Moreover, during the OFF condition of the ignition switch, the output current Io of the power supply circuit 11 is so low to back up the RAM. Thus, the output current Io is generally lower than the threshold current (VF×N/(R14)), so that the power consumption can be reduced by the power consumption of the current source 23 and the overheat detection circuit 24. Thus, this power supply circuit 11 is suitable for backup of RAM 103.

[Second Embodiment]

Figure 2:
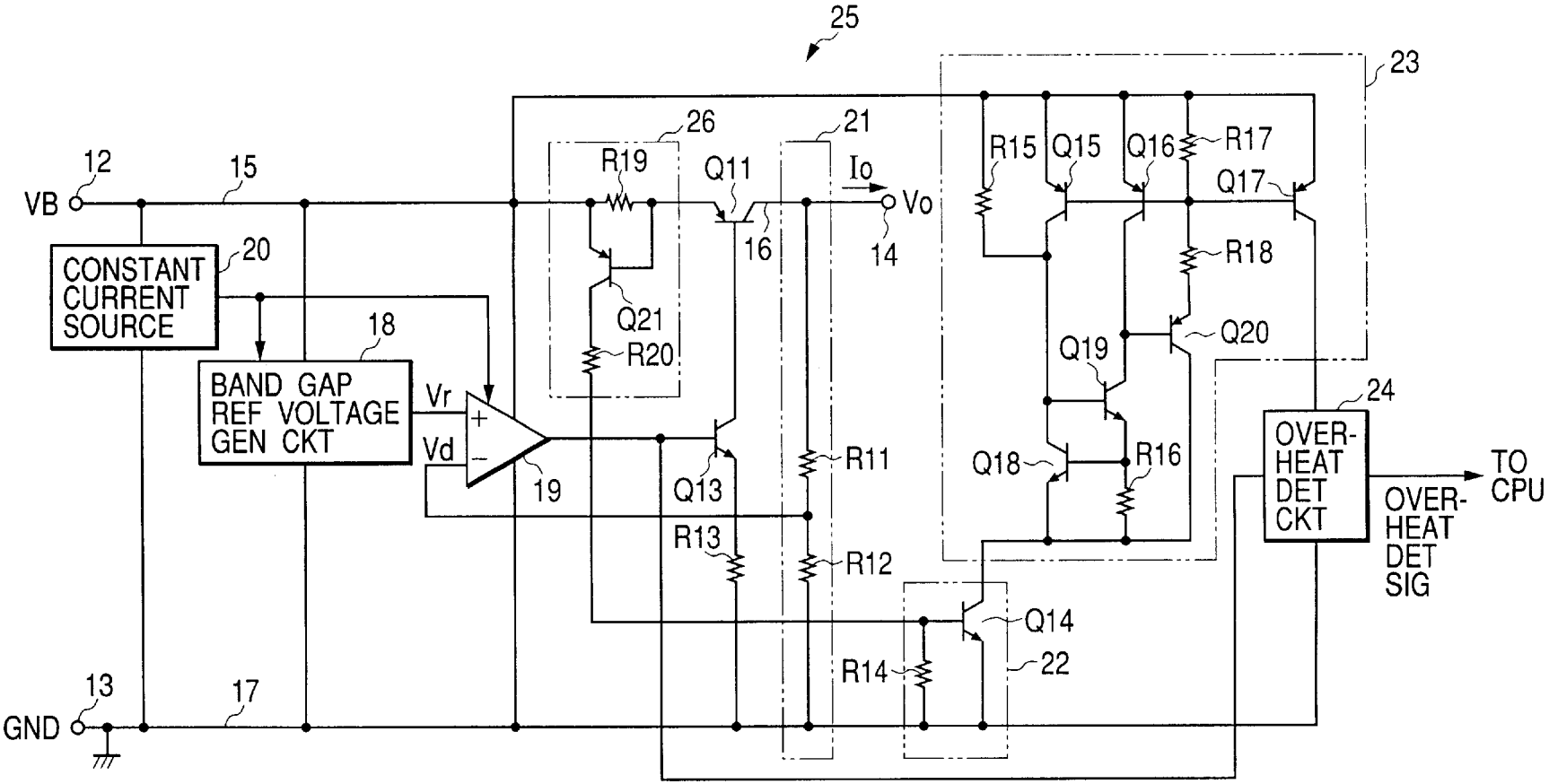
FIG. 2 is a schematic circuit diagram of a power supply circuit according to a second embodiment of the present invention.

FIG. 2 is a schematic circuit diagram of the power supply circuit 25 according to a second embodiment of the present invention.

The structure of the power supply circuit 25 is substantially the same as that of the power supply circuit 11 according to the first embodiment. The difference is in the current detection circuit. That is, a resistor R19 is connected between the input power line 15 and the emitter of the PNP power transistor Q11. An end of the resistor R19 connected to the input power line 15 is connected to an emitter of a PNP transistor Q21 of which base is connected to the opposite end of the resistor R19. The collector of the PNP transistor Q21 is connected to the base of the NPN transistor Q14 through a resistor R20. The resistors R19 and R20 and the PNP transistor Q21 form a current detection circuit 26.

The output current Io from the PNP power transistor Q11 also flows through the resistor R19. Thus, a voltage drop across the resistor R19 is proportional to the magnitude of the output current Io. If the resistance of the resistor R19 is represented by "(R19)", the transistor Q21 turns on under the condition given by:

$$Io \geqq VF/(R19) \quad (2)$$

When the PNP transistor Q21 turns on, a collector current from the transistor Q21 flows through the resistors R20 and R14. If the voltage drop across the resistor R14 exceeds the threshold voltage VF, the transistor Q14 turns on. Here, the resistances of the resistors R14, R19, and R20 are determined by the turning on of the transistor Q14 when the output current Io exceeds the threshold current.

According to this embodiment, the bias current to the overheat detection circuit 24 is not supplied by cutting off the current supplied to the constant current source 23 when the output current Io is low, and thus, the collector dissipation of the PNP power transistor Q11 is low. Accordingly, the power consumption of the IC is reduced by the power consumption in the constant current source 23 and the overheat detection circuit 24. On the other hand, if the output current Io increases, the constant current source 23 and the overheat detection circuit 24 are operated by the turning on of the transistors Q21 and Q14 to protect the IC from the overheat condition.

Moreover, if the output current Io is low, that is (VF/(R19)), the transistor Q21 is turned off. Thus, the current supplied to the bias control circuit 22 is cut off. This reduces the power consumption. Moreover, the bias control circuit 22 has a simple structure because it includes only the NPN transistor Q14 and the resistor R14, and the NPN transistor Q14 does not supply its collector current as long as the output current Io is lower than the threshold current (VF×N/(R14)). These facts can suppress increase in power consumption due to addition of the bias control circuit.

[Modifications]

The above-mentioned embodiment can be modified. For example, the error detection circuit is not limited to the overheat detection circuit 24. That is, any detection circuit for detecting an error caused by the excess in the output current Io of the PNP power transistor Q11 can be used. For example, an overload detection circuit or an over voltage detection circuit may be used.

Moreover, the bias control circuit 22 may be replaced with a comparator for comparing the detection current Id with a predetermined reference current, wherein the power consumption is sufficiently low. This may increase the accuracy in detecting the start of the operation of the overheat detection circuit 24.

The transistor Q14 may be provided with a MOS transistor. In this case, between the gate and source of the MOS transistor, a gate protection circuit such as a Zener diode is favorably provided. The power supply circuit may be structured with a switching regulator configuration.

The power supply circuit basically operates while the ignition switch is OFF, and the error detection circuit, that is, the overheat detection circuit 24, basically operates when the magnitude of the current to the load (RAM) is greater than the threshold value while the ignition switch is OFF. However, during transition from OFF to ON of the ignition switch, this power supply circuit may supply the output voltage to the RAM in the ECU and supply the bias current to the overheat detection circuit 24. Thus, this condition activates protection of the power supply circuit and the overheat detection circuit 24.

What is claimed is:

1. A power supply circuit comprising:

a transistor for supplying a current to a load;

current detection means for detecting a magnitude of said current;

an error detection circuit for detecting an error condition caused by a relatively great magnitude of said current and outputting the detection result; and a control circuit for operating said error detection circuit when said magnitude of said current is greater than a threshold value.

2. The power supply circuit as claimed in claim 1, wherein said control circuit includes a bias circuit for supplying a bias current to said error detection circuit to operate said error detection circuit when said magnitude of said current is greater than said threshold value.

3. The power supply circuit as claimed in claim 1, wherein said transistor comprising a multi-collector structure includes a first collector supplying said current and a second collector supplying a detection current corresponding to said current to detect said magnitude of said current, and wherein said current detection means includes said second collector.

4. The power supply circuit as claimed in claim 1, wherein said current detection means comprises:

a resistor connected in series with said transistor and said load; and a transistor turning ON on the basis of a voltage drop between said resistor.

5. The power supply circuit as claimed in claim 1, wherein said error detection circuit detects overheat as said error condition.

6. An electronic control unit for a motor vehicle comprising:

a first control circuit for effecting a predetermined operation regarding said motor vehicle; and an power supply for supplying a power to said first control circuit including;

a transistor for generating a current as said power;

current detection means for detecting a magnitude of said current;

an error detection circuit for detecting an error condition caused by a relatively great magnitude of said current and outputting the detection result; and a second control circuit for operating said error detection circuit when said magnitude of said current is greater than a threshold value.

7. The electronic control unit as claimed in claim 6, wherein said control circuit including a bias circuit for supplying a bias current to said error detection circuit to operate said error detection circuit when said magnitude of said current is greater than said threshold value.

8. The electronic control unit as claimed in claim 6, wherein said transistor comprising a multi-collector structure includes first collector supplying said current and second collector supplying a detection current corresponding to said current to detect said magnitude of said current, and wherein said current detection means includes said second collector.

9. The electronic control unit as claimed in claim 6, wherein said current detection means comprises:

a resistor connected in series with said transistor and said load; and a transistor turning ON on the basis of a voltage drop between said resistor.

10. The electronic control unit as claimed in claim 6, wherein said error detection circuit detects overheat as said error condition.

* * * * *